US008708516B2

(12) United States Patent
Fischer et al.

(10) Patent No.: US 8,708,516 B2
(45) Date of Patent: Apr. 29, 2014

(54) LIGHTING APPARATUS HAVING RECHARGEABLE BATTERY, CHARGER AND LED BULB

(75) Inventors: Jeremy Laurence Fischer, Wrightstown, PA (US); Aaron Cons, Warrington, PA (US)

(73) Assignee: AfterGlo Lighting Co., Inc., Warminster, PA (US)

( * ) Notice: Subject to any disclaimer, the term of this patent is extended or adjusted under 35 U.S.C. 154(b) by 190 days.

(21) Appl. No.: 13/164,151

(22) Filed: Jun. 20, 2011

(65) Prior Publication Data

US 2012/0320572 A1 Dec. 20, 2012

(51) Int. Cl.

| | |
|---|---|
| ***F21S 9/00*** | (2006.01) |
| ***F21S 9/02*** | (2006.01) |
| ***H05B 37/00*** | (2006.01) |

(52) U.S. Cl.

USPC ..... 362/183; 362/184; 362/186; 362/362; 362/178; 315/86

(58) Field of Classification Search

None

See application file for complete search history.

(56) References Cited

U.S. PATENT DOCUMENTS

| | | | | |
|---|---|---|---|---|
| 4,211,955 | A * | 7/1980 | Ray | 315/53 |
| 5,584,723 | A * | 12/1996 | Sutliff et al. | 439/500 |
| 6,107,744 | A * | 8/2000 | Bavaro et al. | 315/86 |
| 7,429,118 | B1 * | 9/2008 | Borowiak | 362/194 |
| 2004/0070519 | A1 * | 4/2004 | Wu et al. | 340/907 |
| 2005/0157482 | A1 * | 7/2005 | Hsu | 362/20 |
| 2006/0176711 | A1 * | 8/2006 | Wang | 362/555 |
| 2007/0153518 | A1 * | 7/2007 | Chen | 362/252 |
| 2008/0037262 | A1 * | 2/2008 | Wesson | 362/362 |
| 2008/0238359 | A1 * | 10/2008 | Bourilkov et al. | 320/107 |
| 2009/0073678 | A1 * | 3/2009 | Sherer | 362/147 |
| 2009/0154148 | A1 * | 6/2009 | Meyer et al. | 362/157 |
| 2009/0257220 | A1 * | 10/2009 | Lenk et al. | 362/186 |
| 2011/0075404 | A1 * | 3/2011 | Allen et al. | 362/183 |

FOREIGN PATENT DOCUMENTS

| | | | |
|---|---|---|---|
| WO | WO 0184042 | A1 * | 11/2001 |
| WO | WO 2008141343 | A1 * | 11/2008 |

* cited by examiner

*Primary Examiner* — Sikha Roy

(74) *Attorney, Agent, or Firm* — Howson & Howson LLP

(57) ABSTRACT

A low voltage LED bulb having a base that fits a standard light socket designed to receive a bulb operated at line voltage is installed in a conventional lamp, which is connected by a lamp cord to a rechargeable battery, the charge in which is maintained by a charging circuit. The rechargeable battery can be provided in a module equipped with a receptacle capable of receiving a standard plug designed for line voltage, and in this case, the lamp requires no modification other than the replacement of the standard bulb by the low voltage LED bulb. In another embodiment, the battery and charger are incorporated into the lamp.

9 Claims, 3 Drawing Sheets

LIGHTING APPARATUS HAVING RECHARGEABLE BATTERY, CHARGER AND LED BULB

FIELD OF THE INVENTION

This invention relates to lighting and more particularly to a lamp that utilizes a light-emitting diode instead of a compact fluorescent bulb or an incandescent bulb.

BACKGROUND OF THE INVENTION

Conventional incandescent bulbs are inefficient in the sense that a large portion of the electric energy that they consume is converted to heat instead of light. In recent years, incandescent bulbs have gradually been displaced by compact fluorescent lights (CFLs), which are much more efficient. The CFLs, however, are expensive, and take appreciable time to reach full brilliance. CFLs also contain mercury, which is environmentally hazardous. Consequently special measures need to be taken when disposing of spent CFLs.

Conventional incandescent bulbs and CFLs for household use are designed for operation on line current (120 volts AC, 60 Hz, in the United States). Lamp cords supplying current at 120 volts can be hazardous, sometimes causing electrical shock or fire when their insulation becomes worn or when it is chewed by animals.

More recently, the lighting industry has introduced light-emitting diodes (LEDs) that emit light in a color spectrum that is similar to that emitted by a conventional incandescent bulb. LEDs operate on direct current at voltages much lower than the conventional 120 volts available at a household electric receptacle. Consequently, where a conventional incandescent bulb operated on 120 volts AC is to be replaced by a bulb utilizing LEDs, the bulb must be designed to reduce the 120 volts supplied to the light socket, and convert the alternating current to direct current. This can be achieved by using multiple LEDs in a series-parallel arrangement, or by incorporating special electronic circuitry into the bulb.

The following table compares the power consumption of currently available LEDs designed for illumination with incandescent bulbs and compact fluorescent lights having comparable illumination capabilities for various power levels.

TABLE I

| LED | Incandescent Bulb | CFL |
|---|---|---|
| 1 W | 25 W | — |
| 3 W | 40 W | 5 W |
| 5 W | 60 W | 12 W |
| 7 W | 100 W | 24 W |
| 9 W | 150 W | 30 W |
| 12 W | 250 W | 40 W |

In terms of energy consumption, assuming a light is turned on 8 hours each day for 365 days, a 60 watt incandescent bulb consumes about 175 kwH, about 12 times as much energy as a 5 watt LED, and a 25 watt incandescent bulb consumes 73 kwH, almost 25 times as much energy as a 1 watt LED. A 5 watt CFL consumes about 14.6 kwH, about 1.6 times as much energy as a 3 watt LED. A 24 watt CFL consumes about 70 kwH, more than three times as much energy as a 7 watt LED.

LEDs also have a much longer useful life than incandescent bulbs. For example, a typical incandescent bulb has a life of around 1500 hours, whereas an LED will typically operate for 50,000 hours.

LED bulbs designed with standard 26 mm threaded bases for direct replacement of conventional household incandescent bulbs are now widely available at prices such that they "pay for themselves" within a few years. However, when they are used in table lamps, floor lamps and the like, the lamp cord still carries current at a potential of 120 volts AC, and is subject to the same hazards of fire and electric shock as mentioned previously. Moreover, in the event of a power failure, all three kinds of lights, incandescent, CFL, and LED, will go out unless supplied by a back-up generator or an uninterruptible power supply (UPS) of the kind used to avoid sudden shut-down of personal computers. For many, keeping a back-up generator available is impractical, and connecting a UPS to operate one or more lamps is also impractical.

SUMMARY OF THE INVENTION

This invention addresses the problem of providing back-up power for lighting, by utilizing an LED bulb configured to replace a conventional incandescent bulb but designed to operate on a low DC voltage. Current is supplied to the LED bulb from a power source that receives line current as its input, and has its output connected to supply low voltage DC to the LED. The power source includes a rechargeable battery that is recharged by the power source and arranged to supply current to the LED in case of a line power failure.

In a preferred embodiment, the power source is arranged to reduce the voltage from 120 vAC to a low DC voltage, e.g., 12 vDC, at the location of a 120 volt wall receptacle so that all conductors extending from the wall receptacle to the lamp are at low voltage.

The lighting apparatus according to the invention has a number of advantages. The rechargeable battery ensures that the LED lamp will remain lit in the event of a power failure. In an embodiment in which the power supply is built into a unit that plugs into a wall receptacle, all cords extending from the wall receptacle to the lamp carry current at low voltage, and the danger of electrical shock and fire is significantly reduced. If the rechargeable battery associated with a receptacle designed to receive an ordinary 120 volt lamp plug, no changes need to be made to the lamp other than to replace the ordinary 120 volt incandescent bulb or CFL with a low voltage LED bulb having a standard base, e.g. a 26 mm threaded base. The power cord on the lamp and its plug do not need to be changed.

More specifically, the lighting apparatus according to the invention comprises a lamp having a two-terminal socket for receiving a light bulb. A bulb removably fitted into the socket, includes a light-emitting diode having an anode connected to a first of the two terminals of the socket and a cathode connected to a second of the two terminals of the socket. The apparatus includes a rechargeable battery having positive and negative terminals, and a pair of conductors respectively connecting the first terminal of the socket to the positive battery terminal, and the second terminal of the socket to the negative battery terminal. A charger connectible to a source of alternating line current at a voltage of at least approximately 100 volts rms, converts the line current to a DC voltage at a potential substantially lower than the rms value of the line current voltage. The charger has positive and negative output conductors connected respectively to the positive and negative terminals of the battery.

The lamp socket can be a threaded socket, and the bulb can have base with threads that are threadable into the threaded socket. For example, the threaded base can be a standard base having a thread diameter of approximately 26 mm., and one of the two terminals of the base can be the threaded portion of the base.

A preferred embodiment of the lighting apparatus includes a female electrical receptacle having at least two terminals, and a male plug having at least two prongs, the plug fitting the female electrical receptacle to establish contact between each of the prongs and a different one of the least two terminals. The pair of conductors includes two of the at least two terminals of the receptacle and two of the at least two prongs of the plug.

In a preferred embodiment, the charger is contained in a first housing having at least two conductive prongs fixed to the housing and adapted to fit a receptacle supplying alternating current at a voltage of at least approximately 100 volts rms. The rechargeable battery can be contained in a second housing on which the above-mentioned female electrical receptacle is provided. The battery has a voltage, when charged, of approximately 12 volts, and is preferably a 12 volt lithium ion battery.

The charger can be any suitable device for converting alternating line current having voltage of at least approximately 100 volts rms to DC voltage substantially lower than 100 volts suitable for charging the battery. However, preferably, the charger is a switch-mode power supply for receiving alternating current at a voltage in the range from approximately 120 to 240 vAC rms, rectifying the alternating current directly to produce a direct current, switching the direct current produced by rectification to produce a switched voltage, transforming the switched voltage to a lower voltage, and rectifying said lower voltage to produce the low voltage DC output for charging the battery.

Further objects, details, and advantages of the invention will be apparent from the following description when read in conjunction with the drawings.

DETAILED DESCRIPTION OF THE PREFERRED EMBODIMENTS

Figure 1:
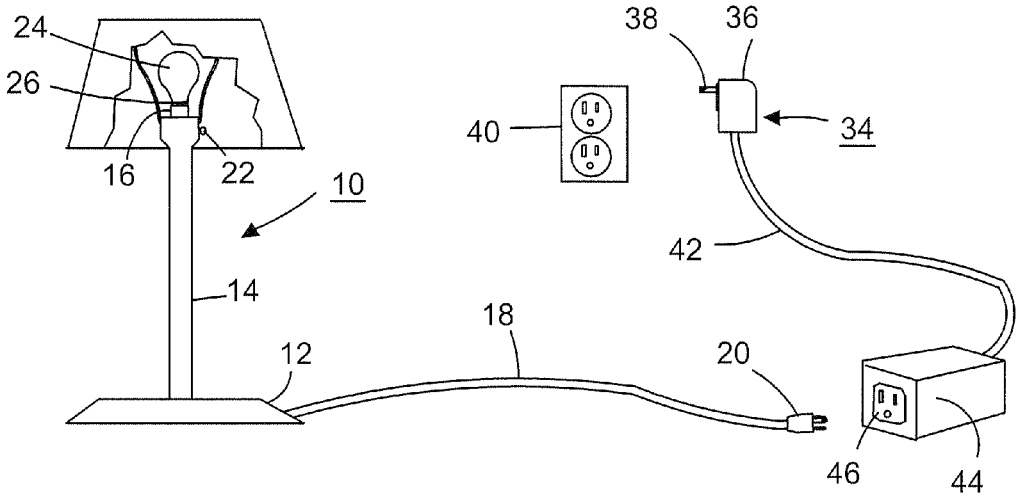
FIG. 1 is a schematic view of an LED lamp and power supply according to a first embodiment of the invention.

The lighting apparatus in FIG. 1 comprises a lamp 10 having a base 12, a post 14, and a socket 16 at the top of the post. A power cord 18 having a standard plug 20 is connected to the lamp and extends upward through the interior of the post 14 for connection to the socket. The plug can be a conventional two-prong plug, preferably polarized by having one prong wider than the other, or three prong plug, as shown, having a ground prong. In the United States, a standard two prong plug has two blades each approximately 17 mm long, 2 mm thick, 7 mm wide. The blades are spaced from each other by 12 mm. In the case of a polarized plug, the "neutral" blade has a width of about 9 mm at least at its tip. The three-prong plug is similar to the two-prong plug, but includes a cylindrical ground pin.

An on-off switch 22 is interposed between one of the conductors and one of the center terminal of the socket. As described so far, the lamp is no different from a conventional floor lamp or table lamp. Lamp 10, however, is fitted with a bulb 24 having a conventional twenty six mm threaded base 26, but containing a light-emitting diode 28 (FIG. 3), having its cathode connected to the threaded portion of the base, which serves as a first contact 30 and having its anode connected to the central base contact 32 (FIG. 3).

Figure 2:
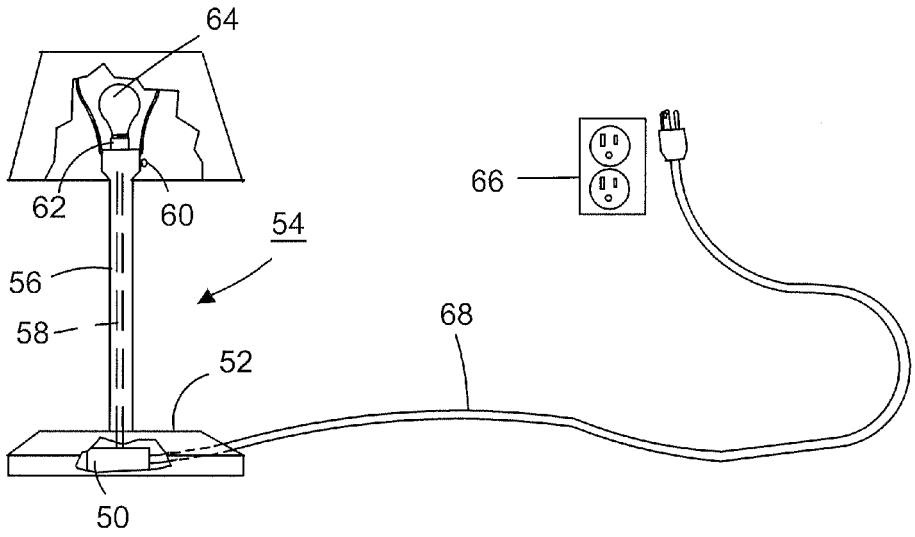
FIG. 2 is a schematic view of an LED lamp and power supply according to a second embodiment of the invention.

As shown in FIGS. 1 and 2, in which corresponding components are identified by the same reference numbers, a charger module 34 has a housing 36 from which two prongs 38 protrude for connection to a conventional wall receptacle 40. The wall receptacle supplies 60 Hz alternating current at approximately 120 volts rms. A two-conductor output cable 42 delivers direct current at approximately 12 volts to a battery module 44 on which is mounted a standard receptacle 46 capable of receiving plug 20.

Figure 3:
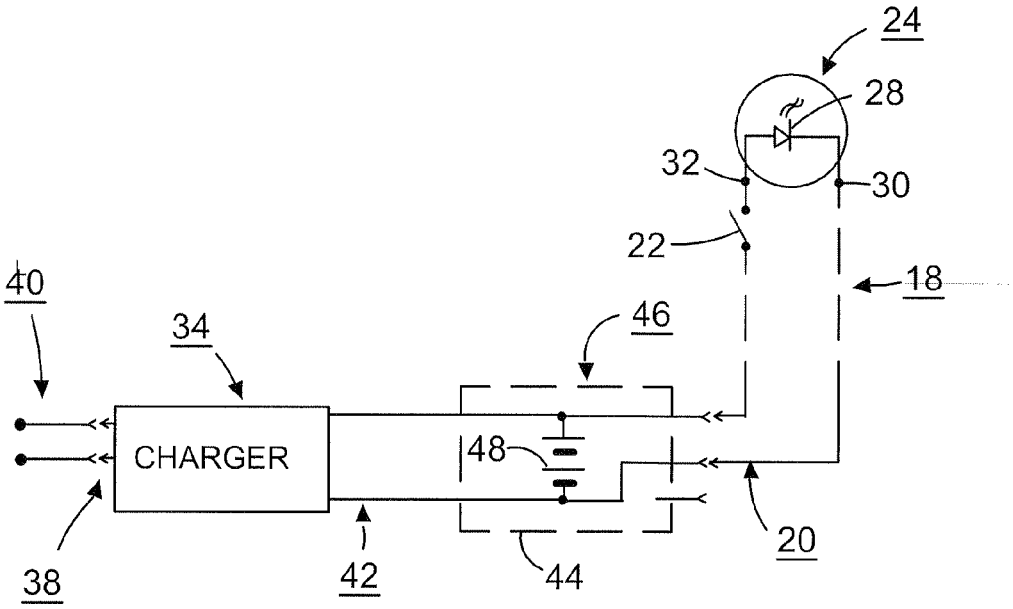
FIG. 3 is an electrical schematic of the LED lamp and power supply of FIG. 1.

As shown in FIG. 3, the battery module 44 contains a battery, preferably a 12 volt lithium ion (Li ion) battery 48, the positive terminal of which is connected through receptacle 46, plug 20, one of the conductors of cable 18, switch 22, and the central contact of lamp 24 and the anode of LED 28. The negative terminal of the battery 48 is similarly connected through another conductor of cable 18, and the threaded part of the lamp base, to the cathode of the LED.

The charger module 34 can be any of a wide variety of devices capable of converting alternating current at a line voltage (e.g., 120 volts) to direct current at a lower voltage (e.g., 12 volts) suitable for operating the LED bulb 24 and for charging the battery 48. Preferably, however, the charger module 34 is a switch-mode power supply of the kind described in U.S. Pat. No. 7,492,619, granted Feb. 17, 2009. The disclosure of U.S. Pat. No. 7,492,619 is here incorporated by reference.

Figure 5:
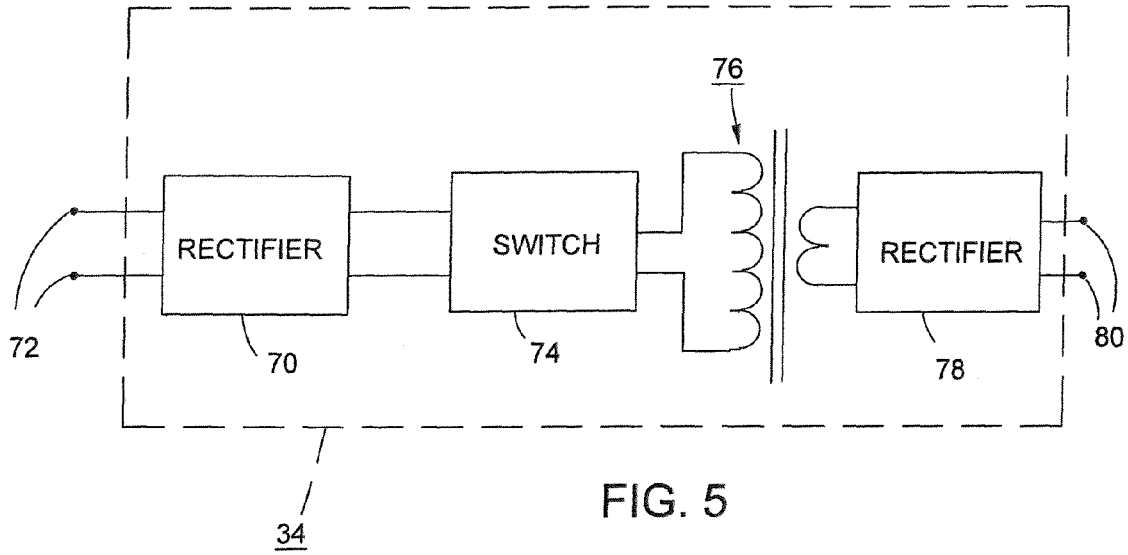
FIG. 5 is a schematic diagram showing components of the charger shown in FIGS. 3 and 4.

Briefly, a switch-mode power supply receives line current, rectifies the line current directly (that is, without first using a transformer to reduce the voltage), and switches the direct current produced by rectification on and off rapidly to produce pulses that are then transformed to a lower voltage and rectified to produce a low voltage DC output. As shown in FIG. 5, the charger 34 includes a rectifier 70 having input terminals 72 for connection to an ac line, a switch 74 for switching the DC output of the rectifier on and off to produce pulses, a step-down transformer 76 having its primary winding connected to receive the output of the switch 74, and another rectifier 78, connected to the secondary winding of the transformer 76, for delivering low voltage DC to output terminals 80. Control of the output voltage of the charger can be achieved by pulse width modulation, using a feedback loop, so that, if the battery is not fully charged, the charger will supply a constant current, e.g., one ampere, to the battery. As the battery charges, its voltage gradually increases to 12 volts and the charger's output voltage also gradually increases to 12 volts. As the battery becomes fully charged, the output current of the charger gradually decreases. A switch-mode power supply can be made to produce a stable output voltage at a desired level and with minimal internal loss, and to accommodate automatically different AC line voltages, e.g., 120 and 240 volts.

In the embodiment shown in FIGS. 1 and 3 a conventional lamp can be used without any modification other than replacement of the conventional 120 volt bulb with an LED bulb capable of operating on 12 volts DC. The lamp cord and plug, which are unchanged, are connected to a battery module having a conventional receptacle, and the battery module is in turn connected to a charger module that can plug directly into a 120 volt AC wall receptacle. The user can therefore readily convert a conventional lamp to an LED lamp, take advantage of the greatly improved efficiency of the LED, have continued lighting in the event of a power failure, and avoid the hazards associated with lamp cords carrying current at the line voltage. A fully charged Li ion battery can keep an LED operating for as many as 10-12 hours.

Various modifications can be made to the apparatus shown in FIGS. 1 and 3. For example, the charger module, instead of being mounted on a wall receptacle, can be connected through a power cord to the wall receptacle. In another modification, The charger module and the battery module can be combined into a single unit that can be either mounted on a wall receptacle or connected through a power cord to the wall receptacle.

Figure 4:
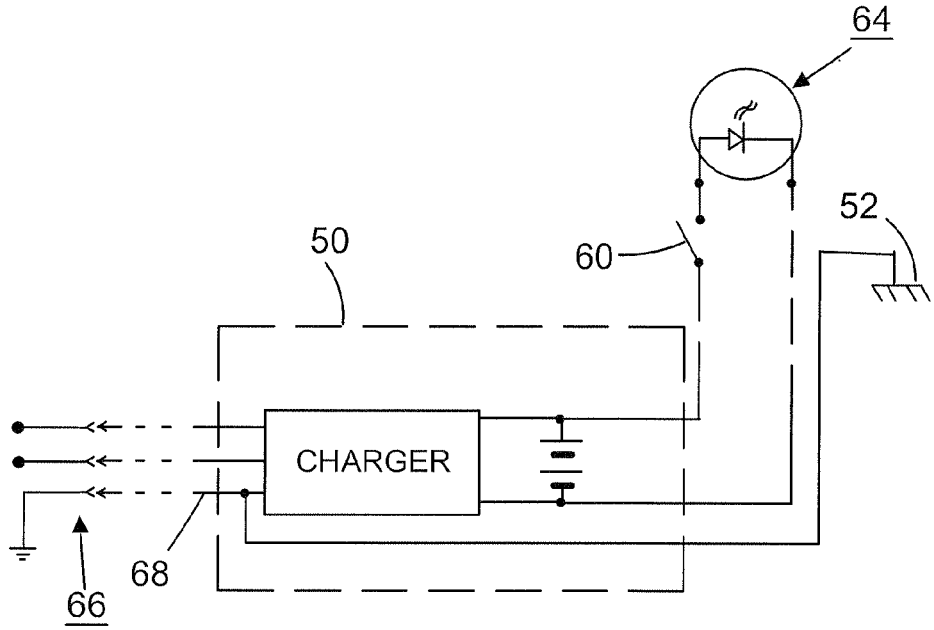
FIG. 4 is an electrical schematic of the LED lamp and power supply of FIG. 2.

The advantage of having continued lighting in the event of a power failure can be realized in a second embodiment in which the charger and battery are combined and built into a lamp, as shown in FIGS. 2 and 4. In this embodiment, a charger/battery module 50 is incorporated into the base 52 of a lamp 54. Two conductors 58 extend through the post 56 of the lamp from the charger/battery module 50 to the lamp's switch 60 and socket 62. An LED bulb 64, similar to bulb 24 in FIGS. 1 and 3, is fitted to the socket. The module is supplied with line current from a receptacle 66 through a power cord 68. Optionally, a power cord having a ground conductor can be utilized, and the ground conductor can be connected directly to the lamp base 52 as shown in FIG. 4.

The embodiment in FIGS. 2 and 4 requires more modification to the lamp and lacks the advantages of the low voltage power cord. However, it provides continued illumination in the event of a power failure.

The combined charger/battery module 50 can also be utilized in a permanent, hard-wired, lighting arrangement, for example, one in which a wall-mounted or ceiling-mounted lighting fixture is controlled by a wall switch. In that case, the charger/battery module can be incorporated into the electrical box to which fixture is attached.

Many modifications can be made to the embodiments described. For example, in the embodiment of FIGS. 2 and 4 separate charger and battery modules can utilized. The bulb can have any of various standard screw bases, a bayonet base, or other form of base. Moreover, the bulb can have connecting pins and can be provided with an adapter receiving the connecting pins and having a base compatible with a conventional socket in a lamp or lighting fixture.

The charger module can be provided with a charge indicator, for example, a circuit responsive to the battery charging current that provides one indication that the battery is fully charged, and another indication when the battery is charging. The charger module can also be provided with an indicator that warns the user that a power failure has occurred.

If the lighting apparatus includes a standard electrical plug such as plug 20 in FIG. 1, the plug should carry a warning that it should not be plugged into a standard AC outlet because doing so could damage the LED. Alternatively, the standard plug 20 and receptacle 46 could be replaced by a special plug and receptacle, the plug being incompatible with a standard AC receptacle.

What is claimed is:

1. A lighting apparatus comprising:

a lamp having a socket for receiving a light bulb, the socket having first and second socket contacts, one of which is constituted by a threaded portion of said socket;

a bulb having a base, the bulb having two bulb contacts one of which is constituted by a threaded portion of said base, and including a light-emitting diode having an anode connected to a first of said bulb contacts and a cathode connected to a second of said bulb contacts, the threaded portion of the base of said bulb being threaded into said threaded portion of said socket whereby the bulb is removably fitted to said socket, with the first and second bulb contacts in electrical contact respectively with said first and second socket contacts, said light-emitting diode being operable to emit light in response to direct current applied to said bulb contacts at a potential substantially lower than 100 volts;

a rechargeable battery having positive and negative terminals;

a pair of conductors respectively connecting said first socket contact to the positive battery terminal, and said second socket contact to the negative battery terminal, the connections of said battery terminals to said socket contacts being independent of the connection of the bulb contacts to the socket contacts;

a charger connectible to a source of alternating line current at a voltage of at least approximately 100 volts rms, for converting said line current to a DC voltage at a potential substantially lower than the rms value of said line current voltage, said charger having positive and negative output conductors connected respectively to the positive and negative terminals of the battery.

2. A lighting apparatus according to claim 1, in which said threads of the base have a diameter of approximately 26 mm.

3. A lighting apparatus according to claim 1, including a first housing having at least two conductive prongs fixed to the housing and adapted to fit a receptacle supplying alternating current at a voltage of at least approximately 100 volts rms, and in which said charger is contained in said first housing.

4. A lighting apparatus according to claim 3, including a second housing containing said rechargeable battery, a female electrical receptacle on said second housing having at least two terminals, and a male plug having at least two prongs, the plug fitting said female electrical receptacle to establish contact between each of said prongs and a different one of said at least two terminals, said pair of conductors including two of said at least two terminals of the receptacle and two of said at least two prongs.

5. A lighting apparatus according to claim 1, including a female electrical receptacle having at least two terminals, and a male plug having at least two prongs, the plug fitting said female electrical receptacle to establish contact between each of said prongs and a different one of said at least two terminals, said pair of conductors including two of said at least two terminals of the receptacle and two of said at least two prongs.

6. A lighting apparatus according to claim 1, in which said battery has a voltage, when charged, of approximately 12 volts.

7. A lighting apparatus according to claim 1, in which said battery is a 12 volt rechargeable battery.

8. A lighting apparatus according to claim 1, in which said charger is a switch-mode, power supply for receiving alternating current at a voltage in the range from approximately 120 to 240 vAC rms, rectifying said alternating current directly to produce a direct current, switching said direct current produced by rectification to produce a switched voltage, transforming the switched voltage to a lower voltage, and rectifying said lower voltage.

9. A lighting apparatus according to claim 1, in which said light-emitting diode is operable to emit light in response to direct current applied to said bulb contacts at a potential of 12 volts.

* * * * *